United States Patent [19]

Wright

[11] 3,932,974

[45] Jan. 20, 1976

[54] GLAZING SYSTEM

[75] Inventor: Gerald Thomas Wright, Bradfordwoods, Pa.

[73] Assignee: Helmerich & Payne, Inc., Houston, Tex.

[22] Filed: Dec. 26, 1973

[21] Appl. No.: 428,346

[52] U.S. Cl. ..... 52/235; 52/400; 52/468

[51] Int. Cl.[2] ..... E04B 2/88

[58] Field of Search ..... 52/235, 400, 403, 475, 52/489, 464, 468, 469, 498, 499, 502

[56] References Cited

UNITED STATES PATENTS

| | | | |
|---|---|---|---|
| 3,336,707 | 8/1967 | Horgan | 52/235 X |
| 3,367,077 | 2/1968 | Johnston | 52/468 X |
| 3,380,210 | 4/1968 | Neal et al. | 52/235 |
| 3,699,735 | 10/1972 | Smith | 52/400 |
| 3,722,161 | 3/1973 | Brown | 52/400 |
| 3,785,104 | 1/1974 | Dailen | 52/235 X |

*Primary Examiner*—Price C. Faw, Jr.
*Attorney, Agent, or Firm*—Murray Robinson; Ned L. Conley; David Alan Rose

[57] ABSTRACT

A curtain wall construction designed for glazing from the inside of the building, with the rubber gasket on the outside of the building, using a T-shaped gasket which fits into an outside facing groove formed in horizontal and vertical members assembled to make a frame for a wall panel, the relative dimensions of the frame and the gasket being such that the gasket may be first installed in the grooves, the wall panel may then be set in place resting against the gasket, and a panel clamping device attached from the inside to clamp the panel against the gasket and also cover the horizontal and vertical members to present a smooth inside appearance.

12 Claims, 6 Drawing Figures

Fig. 3
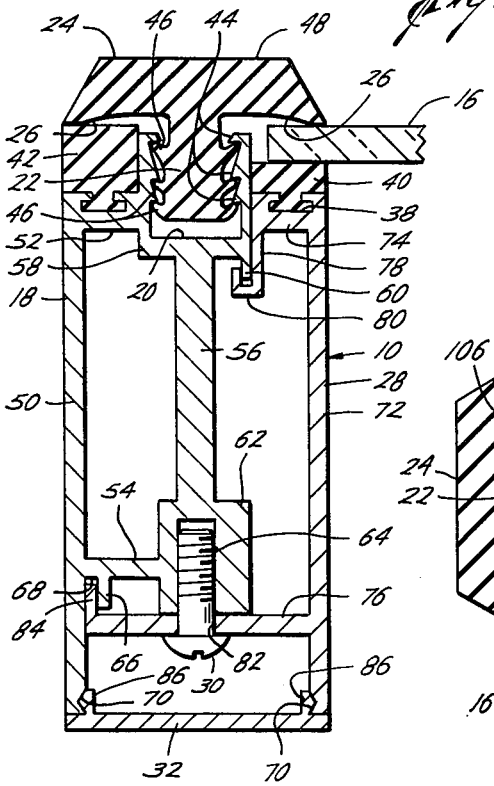
Fig. 6
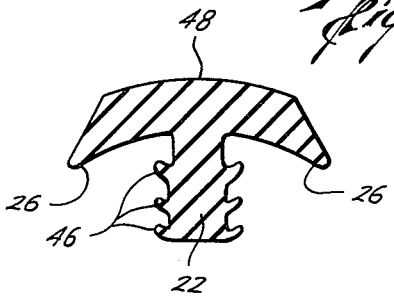
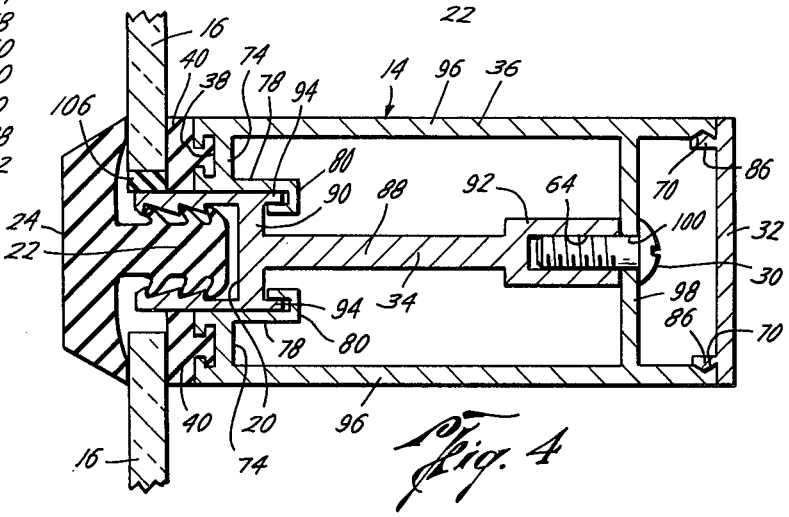
Fig. 4
Fig. 5
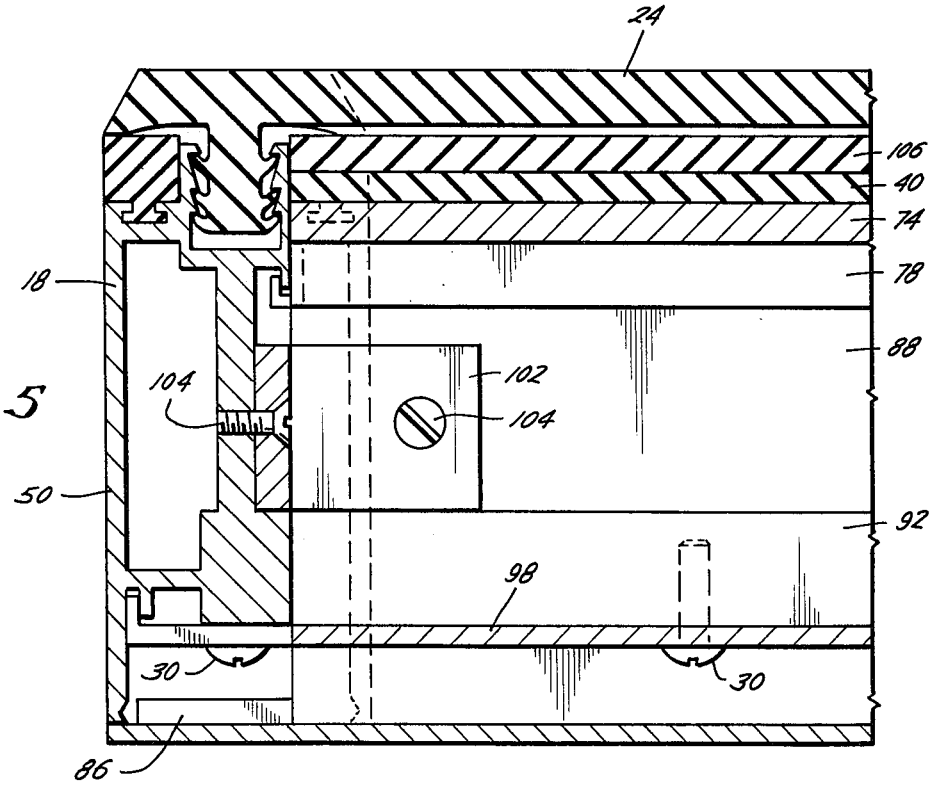

GLAZING SYSTEM

BACKGROUND OF THE INVENTION

1. Field of the Invention

This invention relates to glazing systems for building walls, particularly of the curtain wall type.

2. Description of the Prior Art

In recent years an increasing number of buildings have been constructed with windows and other wall panels supported in elastomeric gasket strips which sealingly retain and cushion the wall panels. Such gasket strips generally comprise an elongated elastomeric body having grooves therein for receiving the edges of glass or other rigid sheets to be joined. The usual gasket strip also includes a wedge-shaped member insertable in a wedge receiving recess in the body of the strip. In such strips a portion of the gasket is bent back to allow the edge of the glass to be inserted into the groove, and then the wedge-shaped member is installed, whereby the elastomeric material is crowded to cause the groove to engage the glass or other rigid sheet more tightly. Such known gasket strips provide a resilient weather seal around the periphery of the panel. Such a gasket strip is disclosed, for example, in U.S. Pat. No. 3,068,617 to Borski. Such gaskets have been highly successful, but present difficulties in opening the groove to insert the glass, and in proper installation of the wedges, special tools usually being required.

In some installations conventional masonry and like building walls are replaced by a form of curtain wall construction consisting of an open structural frame work that either supports a panel within the open space defined by the structural frame work or has separate panel framing elements attached to one face of the structural frame work. The structural frame work and panel framing elements are generally composed of a number of extruded metal members that may be joined to form a single module, but are more frequently joined into a multiple module grid structure. A problem which has arisen in such installations involves the provision of a thermal barrier between the panel members and the grid members to prevent heat transfer from one member to thhe other, while providing a curtain wall system that is capable of fully meeting design specifications, both with respect to esthetics and performance. At the same time it is desirable to provide a sound barrier to decrease sound transmission between the exterior and interior of the building.

Systems attempting to solve these problems have heretofore been designed, as shown, for example, in U.S. Pat. Nos. 3,336,707 to Horgan, Jr., 3,488,906 to Brooks, and 3,699,735 to Smith.

Although the glazing systems disclosed in these patents have been found acceptable in many installations, problems of esthetics and difficulty of assembly have occurred in many cases. For example, the structure disclosed by Horgan, Jr. must be assembled from scaffolds on the outside of the building unless the building owner is willing to have the glazing gaskets with the wedges on the inside of the building. This is due to the fact that it is necessary to insert the wedges to clamp the panels after the panels are in place. Thus if, as is usually the case, the building owner prefers to have the smooth metal extrusions on the inside, scaffolding must be erected for construction of the curtain wall from the outside.

Brooks avoids this problem, but only by use of a large number of complex pieces in his assembly, so that construction is made more difficult and time consuming.

Smith's design can also be constructed from the interior of the building with the gasket on the outside but in this design difficulty is encountered in opening the grooves of the gasket to insert the panels, and then holding the gasket and panels in place while inserting the wedge to clamp the panels, followed by attaching this assembly to the metallic structure.

Such glazing systems as these utilize the gasket as a structural member; i.e., in addition to having the gasket function of sealing, the gasket has a structural support function of providing support for the wall panel members, such as glass. Thus such gaskets differ considerably from ordinary gaskets which provide only a sealing function, such as around refrigerator doors and the like.

SUMMARY OF THE INVENTION

According to the present invention the foregoing problems are avoided by the use of a combination of frame members with an outwardly facing groove, a gasket having a tongue engaged in the groove and panel engaging faces facing the frame member, and a compression member which presses against the panel and is fastened to the frame member to hold the panel in sealing engagement with the gasket. The dimensions of the opening formed by the frame members is greater than the dimensions of the panel, and the panel engaging faces of the gaskets are dimensioned to form an opening smaller than the panel, so that the frame members can be installed first, thereby providing support for the remainder of this assembly, and then the gaskets are installed in the grooves of the frame members. Since no wedge is required for obtaining sealing engagement of the gasket with the panel, the gasket may be on the outside of the building even though the entire curtain wall is constructed from the inside of the building. Once the gaskets are installed the panels may be set in place against the sealing faces of the gaskets, and compression members, fastened to the frame members, installed from the inside to press against the panels, holding them in sealing engagement with the gaskets. The compression members may be designed to present a smooth pleasing appearance on the inside of the building.

According to this invention a T-shaped gasket is used which has locking means on its leg portion for retaining the gasket in a groove, and an uninterrupted convex face on top of the T. Upon installation in the groove, with the glass pressed against the sealing faces of the T with a force sufficient to provide a sealing pressure, the gasket yields until the top face is substantially flat.

The system of this invention is much more easily installed than those previously used, thereby achieving a saving in cost. The system provides a good thermal and sound transmission barrier, since the panel members are insulated from the metallic members. Furthermore, the principal structural members are concealed in the final assembly, so that these do not have to be finished.

BRIEF DESCRIPTION OF THE DRAWINGS

FIG. 3 is a horizontal sectional view of a portion of the embodiment shown in FIG. 2, taken at line 3—3 of FIG. 1;

FIG. 4 is a vertical sectional view of a portion of the embodiment shown in FIG. 2, taken at line 4—4 of FIG. 1;

FIG. 5 is a horizontal sectional view of a portion of the embodiment shown in FIG. 2, taken at line 5—5 of FIG. 1; and FIG. 6 is a sectional view of the glazing gasket of this invention, shown in its "as-molded" form.

DESCRIPTION OF THE PREFERRED EMBODIMENTS

Figure 1:
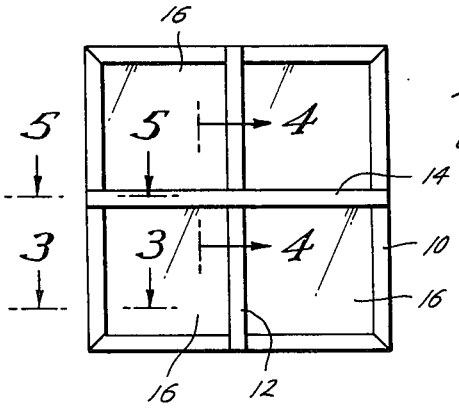
FIG. 1 is an elevational view of a curtain wall module.

FIG. 1 depicts a typical curtain wall module comprising perimeter structure 10 and vertical and horizontal mullions 12 and 14, respectively, forming a frame for four panels 16.

As best seen in FIG. 3, the perimeter portion 10 of the frame comprises an elongate metal structural support member 18 provided with an outwardly facing (toward the outside of the building) groove 20 in which the tongue 22 of a T-shaped gasket 24 is received. The member 18 is preferably made of extruded aluminum. The panel 16, which may be made of glass or any other desired material, is held in sealing engagement with one of the sealing faces 26 on the arms of the T by means of an elongate metal (preferably extruded aluminum) compression member 28 which is secured to the stiffening member 18 by means of a screw 30. The compression member also serves as a cover for the side of the support member 18. The screw 30, and the inner edges of the stiffening member 18 and the compression member 28 are covered by an elongate metal (preferably extruded aluminum) cover plate 32.

The vertical and horizontal mullions 12 and 14, as depicted in FIG. 4, comprise an elongate structural support member 34 having an outwardly facing groove 20 therein for receiving the tongue 22 of the gasket 24. The panels 16 are held in engagement with the sealing faces of the gasket by means of compression member 36 which is attached to the stiffening member 34 by means of a screw 30, and which also serves as a cover for both sides of the support member 34. A cover plate 32 also covers the inside edge of the compression member 36.

Each of the compression members 28 and 36, as well as the support member 18, is provided with a groove 38 for engagement of resilient backing strips or gaskets 40 and 42. These may either be molded in place or provided with extending tongue portions which may be snapped into the grooves 38. As seen, the resilient backing strips 40 bear against the panel 16, whereas the strip 42 bears against one of the sealing faces 26 of the gasket 24, since this backing strip is used at the edge of the module and no panel is retained on this side of the support member 18.

The groove 20 is provided on its side walls with a plurality of longitudinally extending ridges 44 which cooperate with corresponding barbs 46 extending longitudinally along the opposed sides of the tongue 22 which forms the leg of the T-shaped gasket 24, thereby providing means for retaining the gasket in the groove.

As molded, the gasket appears as shown in FIG. 6, the body being curved so that the upper surface 48 is convex. The gasket is made of natural or synthetic rubber or other elastomeric material, preferably conforming to "ASTM Specification and Methods of Test for Elastomeric Structural Glazing and Panel Gaskets No. C-542-71a."

The sealing faces 26 of the gasket are curved in the same direction as the upper surface 48, but are curved further downwardly toward the plane of the end of the tongue 22, so that when the gasket is installed, as shown in FIG. 3, for example, and the upper surface 48 is substantially flat, the tip ends of the sealing faces engage the panel while that portion nearest the tongue is spaced away from the panel. Thus sealing pressure is concentrated near the edge.

In the embodiment shown in the drawing, the support member 18 comprises a flat panel portion 50 adapted to be attached to adjacent structure (not shown) and a pair of perpendicularly extending webs 52 and 54 connected to a rib 56. The web 52 has the groove 38 formed therein and connects to an enlarged portion 58 of the rib 56 in which the groove 20 is formed. The enlarged portion 58 has formed on one side thereof a downwardly extending, as viewed in FIG. 3, flange 60. The other edge of the rib 56 is also enlarged at 62 and contains a plurality of threaded holes 64 spaced apart longitudinally along the length of the rib 56. The web 54 connects to the enlarged portion 62. Web 54 has a downwardly extending flange 66 forming a groove 68 between it and the flat panel 50. At the lower end of the panel 50, as shown in FIG. 3, a longitudinally extending cover retaining notch 70 is provided.

The compression member 28 also comprises a flat panel portion 72 extending its full width, and perpendicularly extending webs 74 and 76. The web 74 has the groove 38 formed in its upper surface, as shown in FIG. 3, and a downwardly extending flange 78 terminating in a J-hook portion 80 dimensioned to receive the flange 60. The other web 76 is provided with a hole 82 through which the screw 30 passes, and terminates at its end with an upstanding flange 84 proportioned to be received in the groove 68.

The cover plate 32 is a flat plate provided with a pair of ears 86 positioned and proportioned for engagement in the grooves 70 in the stiffening member 18 and the compression member 28.

The support member 34 used in the mullion sections comprises a center web 88 terminating at its edges in enlarged portions 90 and 92. The enlarged portion 90 has formed therein the groove 20, and has extending in the opposite direction from its upper and lower edges, as seen in FIG. 4, a pair of flanges 94. The enlarged portion 92 has a threaded hole 64 formed therein to receive the screw 30.

The compression member 36 is generally H-shaped in configuration, comprising a pair of flat side panels 96 connected by a web 98, and also having a web 74 extending laterally inwardly on each side at the outer edge. The webs 74 terminate in flanges 78 extending at right angles thereto and spaced apart a distance to slidingly receive the enlarged portion 90 of the stiffening member 34. The flanges 78 terminate in J-hook portions 80 which are proportioned to slidingly receive flanges 94. The web 98 is provided with a hole 100 through which the screw 30 extends. Grooves 70 are provided adjacent the inner edge of each side panel 96 to receive the ears 86 of the cover plate 32.

Figure 2:
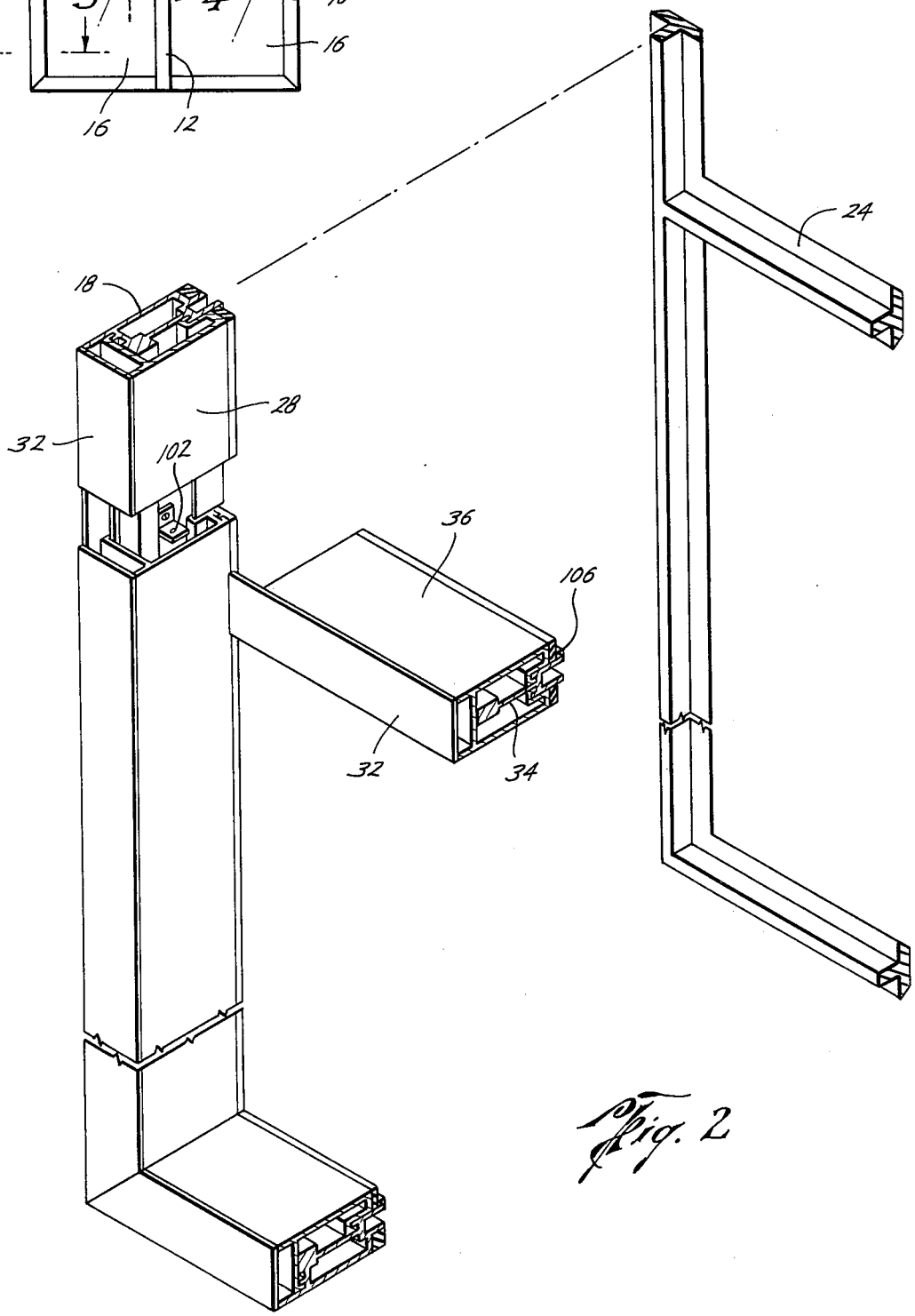
FIG. 2 is an exploded isometric view of one embodiment of the curtain wall construction of this invention.

In assembly of the curtain wall structure of this invention, the perimeter support members 18 are first bolted, or otherwise fastened, by means not shown, to the surrounding support structure, each of the perimeter stiffening members preferably being beveled, as shown in FIGS. 1 and 2, for connection together. The horizontal and vertical mullion support members 34 are then fastened to the perimeter support members, as by means of angle brackets 102 fastened to the members by, for example flat head screws 104. The horizontal mullion support members may, for example, be cut between the vertical perimeter support members, and the vertical mullion support members cut between the horizontal mullion support members.

These support members may have the backing strips 40 and 42 already installed or the gaskets may be snapped into the grooves 38 following installation of the support members in the wall. The gasket 24, which may be made of a plurality of sections or may be molded in one piece for the entire module, as indicated in FIG. 2, is then installed by inserting the tongue 22 into the grooves 20 far enough to insure engagement of all of the barbs 46 with the ridges 44. It will be apparent that this gasket is readily installed by a person standing inside of the building even though the groove in which the tongue is inserted faces outwardly.

Once the gasket 24 is installed, resilient setting blocks 106 are installed on horizontal frame members to support the wall panel and prevent it from resting on the metallic frame member. The wall panel sections are then readily inserted into the frames from the inside of the building. Since the dimensions of the space between the support members are greater than the dimensions of the glass or other wall panel member to be inserted, the glass may be set between the stiffening members, resting on the setting blocks 106, and resting against the gasket 24.

The compression members are than installed, the compression members 36 on the horizontal mullions preferably being installed first. The spacing between the J-hooks 80 is greater than the width of the enlarged portion 92 of the support member 34, so that the compression member can be installed over the support member, the J-hooks 80 engaging the flanges 94. Thus, interlocking and proper positioning of the compression member relative to the support member 18 are assured. The screw 30 is then inserted and tightened, thereby providing a force on the panel tending to move it outwardly of the curtain wall structure and increasing the pressure of the wall panel against the sealing face 26 of the gasket 24. Ideally, the various elements should be designed so that upon full tightening of the screw 30 the upper surface 48 of the gasket 24 will be substantially flat, being deformed, in the usual case, approximately one-eighth inch to one quarter inch, with a force of deformation in the range of four pounds to eight pounds per lineal inch of gasket, depending upon the wind loading which the wall will be required to withstand. The amount of deformation can be varied by varying the thickness of the backing strips 40. The structure could also be adapted to different glass thicknesses by merely changing the thickness of the backing strips. Where prior art gaskets using a wedge are used, on the other hand, this is not possible, since loading pressure and glass thickness are determined by the design of the gasket.

The barbs 46 are designed to have sufficient strength to withstand the load applied by the action of the compression members against the panels. If necessary, the barbs may be reinforced, or other means, such as spring clips or a separate metal clamp, may be used to retain the tongue in the groove.

Following the installation of the horizontal compression members 36, the vertical compression members are cut in between and installed in a similar manner. Then the perimeter compression members 28 are also installed, sliding on to engage the flange 60 in the J-hook portion 80 and the flange 84 in the groove 68. When all of the screws 30 have been tightened so as to sealingly compress the panels 16 against the gasket 24, the cover plates 32 are snapped into place by applying pressure to force the ears 86 into the grooves 70. The installation is then complete.

It will be appreciated that only the compression members 28 and 36 and the cover plates 32 need have a finish surface on them, since the support members are concealed. The entire installation is easily made from the inside without any special tools, the gasket 24 providing means for holding the panel in place during installation of the compression member.

In the event that replacement of a panel is ever necessary, this is also readily accomplished from the inside, since it is only necessary to remove the cover plates 32 and the screws 30 in order to allow removal of the compression members for complete access to the panels 16.

An excellent thermal and sound barrier is provided since only the gasket and the wall panel is exposed to the outside, and insulating materials, including the backing strips 40, separate the panels 16 from any metal frame members.

Although a preferred embodiment of the invention has been shown and described, the invention is not limited to this embodiment, but instead includes all variations thereof which will be apparent to those skilled in the art, as defined by the appended claims.

I claim:

1. Curtain wall structure for use in the wall of a building, comprising an elongate structural support member having an outside edge and an inside edge, a longitudinally extending groove in the outside edge, a longitudinally extending resilient sealing member engaged in said groove, said sealing member having at least one laterally extending sealing lip facing toward said structural support member, a wall panel sealingly engaged by said sealing lip, a longitudinally extending compression member engaging said wall panel in such a way as to hold it in sealing engagement with said sealing lip, and means for attaching said compression member to said structural support member to hold the compression member in position, said compression member covering the structural member from the inside edge to the outside edge, and an inside cover plate concealing the inside edge, so that none of the structural member is visible.

2. A structural panel support comprising horizontal and vertical support members interconnected to form a frame, each member having an outwardly directed longitudinal mounting groove in one common vertical face thereof, an elastomeric structural glazing gasket having a body portion and a tongue portion, said tongue portion being mounted in said grooves and said body portion being in position for supporting engagement with a panel, a wall panel supported by said glazing gasket, and means engaging said members and said panel holding said panel in sealing engagement with the body portion of said gasket, said means including a cover plate extending from said panel inwardly to beyond a portion of each said horizontal and vertical member, and means engaging each said cover plate and the corresponding member for tightening the engagement of the panel with the gasket.

3. A structural panel support comprising horizontal and vertical support members interconnected to form a frame, each member having an outwardly directed longitudinal mounting groove in one common vertical face thereof, an elastomeric structural glazing gasket having a body portion and a tongue portion, said tongue portion being mounted in said grooves and said body portion being in position for supporting engagement with a panel, a wall panel supported by said glazing gasket, means engaging said members and said panel holding said panel in sealing engagement with the body portion of said gasket, said body portion of the gasket forming an outside cover for the edges of the panel, the dimensions of the space between the horizontal and vertical members being greater than the dimensions of the panel, whereby the panel may be installed from the inside, said means holding the panel in sealing engagement with the gasket including a cover plate extending from said panel inwardly to beyond a portion of each said horizontal and vertical member, and means engaging each said cover plate and the corresponding member for tightening the engagement of the panel with the gasket.

4. A structural panel support as defined by claim 3 wherein the engaging means comprises an adjusting screw operable from inside.

5. Curtain wall structure for use in the wall of a building, comprising an elongate structural support member having an outside edge and an inside edge, a longitudinally extending groove in the outside edge, a longitudinally extending resilient sealing member engaged in said groove, said sealing member having at least one laterally extending sealing lip facing toward said structural support member, a wall panel sealingly engaged by said sealing lip, a longitudinally extending compression member engaging said wall panel, and means for attaching said compression member to said structural support member, said attaching means being adapted to force the compression member toward said wall panel and sealingly engaging said wall panel, whereby the compression member is placed in compression and held in position.

6. Curtain wall structure as defined by claim 5 wherein said compression member is attached to said inner edge of said structural support member.

7. Curtain wall structure as defined by claim 5 and including a plurality of such structural members, sealing members and compression members connected together to form a frame supporting said wall panel, the dimensions of the space between said plurality of structural members being greater than the dimensions of said wall panel.

8. Curtain wall structure as defined by claim 5 and including a resilient backing strip between the wall panel and the compression member.

9. Curtain wall structure as defined by claim 5 and including cooperative retaining means on said sealing member and in said groove.

10. Curtain wall structure for use in the wall of a building, comprising an elongate structural support member having an outside edge and an inside edge, a longitudinally extending groove in the outside edge, a longitudinally extending resilient sealing member engaged in said groove, said sealing member having at least one laterally extending sealing lip facing toward said structural support member, a wall panel sealingly engaged by said sealing lip, a longitudinally extending compression member having an outside edge and an inside edge and engaging said wall panel in such a way as to hold it it sealing engagement with said sealing lip, means for attaching said compression member to said structural support member to hold the compression member in position, said inside edge of the compression member being attached to the inside edge of the structural support member.

11. Curtain wall structure for use in the wall of a building, comprising an elongate structural support member having an outside edge and an inside edge, a longitudinally extending groove in the outside edge, a longitudinally extending resilient glazing gasket, said glazing gasket being of T-shaped cross-section including a tongue and laterally extending arms, sealing faces on the side of the arms toward the tongue, the opposite side of said arms forming a continuous convex surface, and the sealing faces curving in the same direction as the said opposite side, so that the tip of each arm is substantially nearer the plane of the end of the tongue than is the base of each arm, cooperative retaining means on said tongue and in said groove, said tongue being retained in said groove by said cooperative retaining means, a wall panel sealingly engaged by each sealing face, a longitudinally extending compression member engaging each said wall panel in such a way as to hold it in sealing engagement with the engaging sealing face, and means for attaching said compression member to said structural support member to hold the compression member in position.

12. Curtain wall structure as defined by claim 11 and including a plurality of such structural members, glazing gaskets and compression members connected together to form a frame supporting said wall panel, the dimensions of the space between said plurality of structural members being greater than the dimensions of said wall panel.

* * * * *